United States Patent [19]

Müller et al.

[11] Patent Number: 4,913,370

[45] Date of Patent: Apr. 3, 1990

[54] COIL COLLECTING STATION FOR WIRE-ROD MILL TRAINS

[75] Inventors: Peter Müller, Neuss; Dieter Figge, Essen, both of Fed. Rep. of Germany

[73] Assignee: Duetsche Voest-Alpine Industrieanlagenbau GmbH, Duesseldorf, Fed. Rep. of Germany

[21] Appl. No.: 265,912

[22] Filed: Nov. 2, 1988

[30] Foreign Application Priority Data

Nov. 4, 1987 [DE] Fed. Rep. of Germany ..... 3737418

[51] Int. Cl.[4] ..... B65H 49/00; B65H 75/24; B21C 47/24; B21C 47/30

[52] U.S. Cl. ..... 242/72 R; 72/134; 72/148; 242/110.1

[58] Field of Search ..... 72/134, 135, 146, 148, 72/478; 242/72 R, 82, 84, 110.1, 110.2

[56] References Cited

U.S. PATENT DOCUMENTS

| | | | |
|---|---|---|---|
| 1,428,119 | 9/1922 | Rogers | 242/110.1 |
| 1,905,178 | 4/1933 | Kohler | 242/72 R |
| 2,457,786 | 12/1948 | Slayter | 242/110.1 |
| 2,628,040 | 2/1953 | Rayburn | 242/110.1 X |
| 2,983,465 | 5/1961 | Skubal | 242/110.1 |

FOREIGN PATENT DOCUMENTS 3525089 1/1987 Fed. Rep. of Germany .

*Primary Examiner*—E. Michael Combs
*Attorney, Agent, or Firm*—Barnes & Thornburg

[57] ABSTRACT

Described is a coil collecting station for wire-rod mill trains with a coil collecting chamber consisting of a pre-collector, collecting pin and limiting cage, in which at least two collecting pins can be brought alternatively into a loading and/or discharging position by means of swing movements. The enveloping diameter of the collecting pin in the loading position is variable with respect to its diameter in its discharging position for a wire coil wound up thereon. For this purpose, said collecting pin consists of a plurality of pin rods, some of which being fixed and the other ones being supported radially movably with respect to said fixed pin rods.

14 Claims, 5 Drawing Sheets

COIL COLLECTING STATION FOR WIRE-ROD MILL TRAINS

BACKGROUND AND SUMMARY OF THE INVENTION

The invention relates generally to a coil collecting station for wire-rod mill trains with a coil-forming chamber.

In wire-rod mill trains of this general type, the wire windings produced in a winding former are transported spread-out to the coil-forming chamber via a suitable transport system such as a roller bed through an air cooling section. The coil-forming chamber consists of the so-called pre-collector, the collecting pin proper and a limiting cage surrounding said collecting pin for limiting the coil toward the outside. A plurality of flaps are usually disposed between the pre-collector and the collecting pin, which permit, in swung-in position, the discharging, i.e. removing of a just coiled-up collecting pin, whereas, in the meantime, newly arriving wire windings fall at first upon said flaps.

In a known station of the said class (DE-OS No. 35 25 089), the collecting pin consists of a tube provided with a rounded-off head profile at which protruding lateral guide bodies are provided on opposite sides. A U-shaped segment is firmly connected with said tube. Another corresponding segment is provided radially displaceable on the lower side of the tube in coil transfer position. The latter segment is pivoted to an arm of a two-arm lever each, which in turn carries a pull rod and is firmly connected to the said tube.

In the case of the known collecting station with variable envelope diameter of the collecting pin it is, however, not possible to effect the diameter variation of the pin on the one hand, and its swing from the loading position to the discharging position on the other hand by means of a single drive element.

The double-lever arrangement is felt to hamper a reliable mode of operation and the constructive effort is considered to be too high.

In this respect, it is the task of the invention, to develop the known station in a manner that a constructively simplified pin build-up with a correspondingly simplified actuation possibility will ensue.

The spreadability of the collecting pins is characterized by a simple mechanism which is therefore not prone to failures, with only a slightly increased constructive effort. The required movable parts are restricted to a minimum required and are disposed within said coil so that they are reliably protected against the still very hot wire during the collecting process. A further especially advantageous feature is, that the variation of the diameter of the collecting pin or of each collecting pin respectively is actuated via the same drive element with which the pins are swingable into and respectively out of the loading station into the discharging position.

Details of the device according to the invention are further described in the following description, taking reference to the respective drawings which show an advantageous and only typical embodiment.

DESCRIPTION OF THE PREFERRED EMBODIMENT

Figure 1:
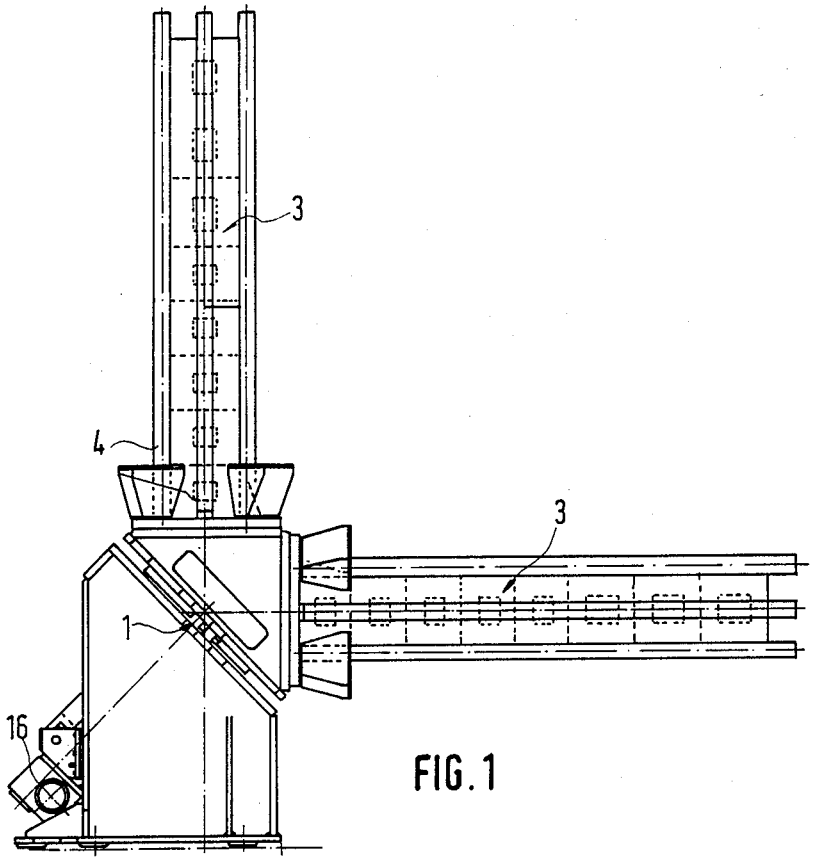
FIG. 1 a simplified side view of a twin collecting pin arrangement with pivot drive in the underframe.

FIG. 1 illustrates a coil collecting station taking the example of a twin collecting pin arrangement in which two collecting pins 3 are pivoted to a swing pin underframe 1 so that they can be brought alternately into a loading position and a discharging position by means of a pivot drive. Each collecting pin 3 consists of a plurality of pin rods.

Figure 2:
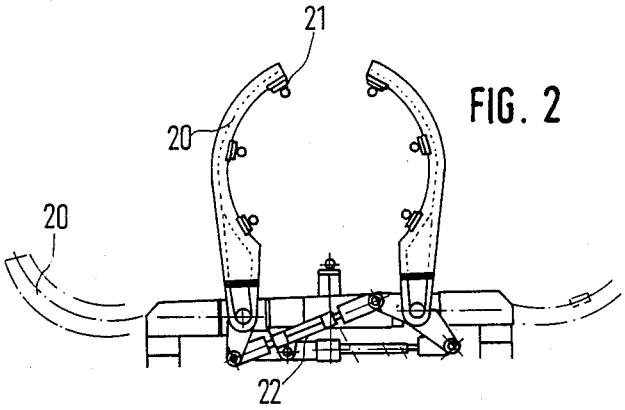
FIG. 2 a top view upon a swing-out outer cage and the envelope of a wire coil.

FIG. 2 shows the top view on a limiting cage which is composed of two cage halves (20) held in the closed position as represented by full lines, whereas they are brought into the open position for being discharged, as shown by hatched lines. This is controlled by a drive mechanism 22 which is able to swing the two cage halves 20, as represented, from the closed position into the open position and vice versa. Along the inner sides of each of the cage halves 20, rolls or rods 21 are located parallel to the center line of each collecting pin 3, which allow to minimize the contact with the coiled-up wire coil.

Details of the collecting pin as built according to the invention are shown in FIGS. 3 through 6. The swingable collecting pins as represented in said figures are characterized by a plurality of pin rods 4, 5, the pin rods 4 which are fixed pin rods and the pin rods 5 which are disposed movably as will be described further in the following.

Figure 3:
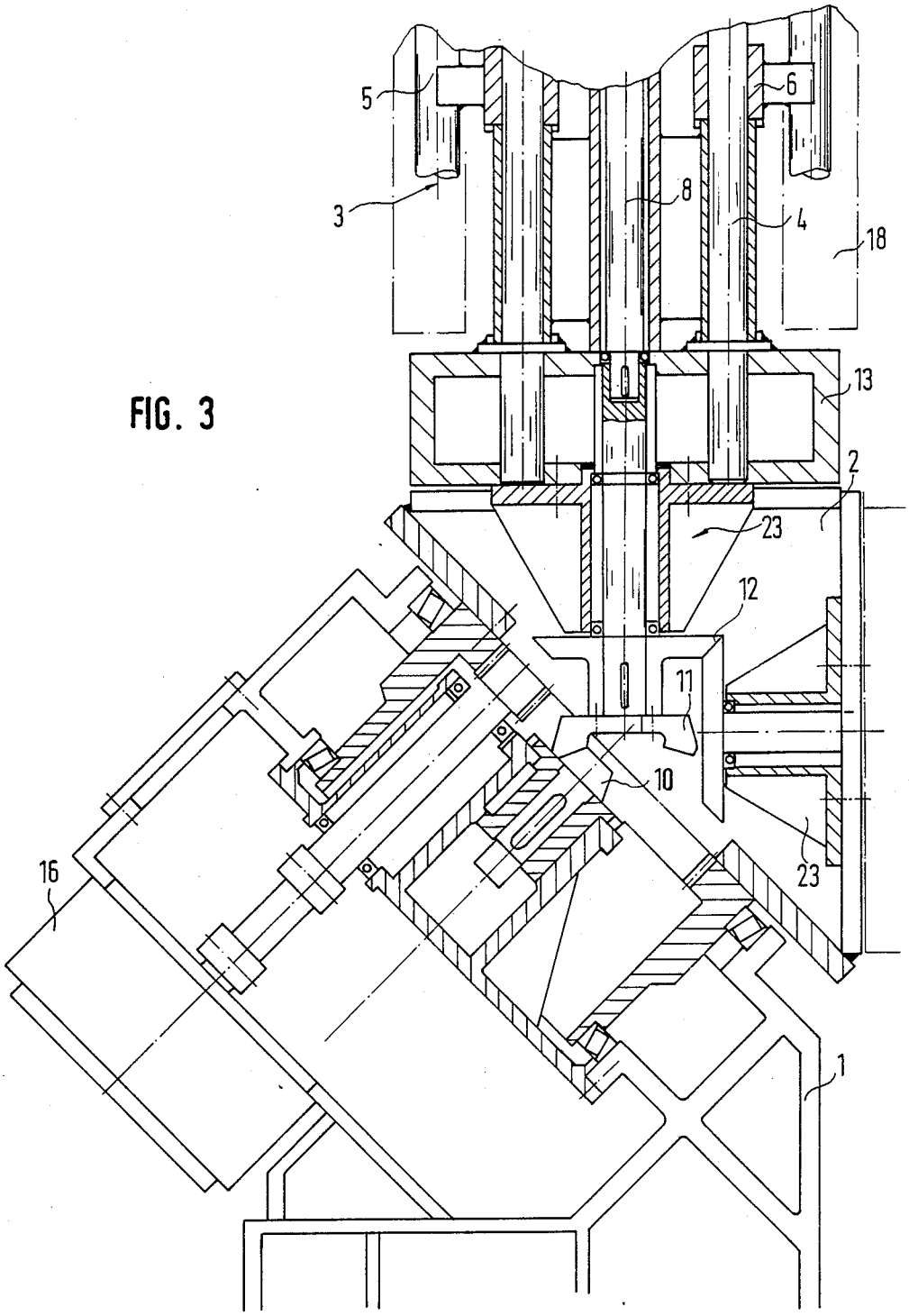
FIG. 3 a longitudinal section through a swing pin underframe with associated pin arrangement.

FIG. 3 shows in particular how the collecting pin 3 is supported at and upon the swing pin underframe 1 which is implemented in a manner as such known so that it is in a position of swinging a twin pin arrangement by means of the pivot drive 16 alternatively into their loading and discharging positions. The build-up of the swing head 2 is therefore no subject matter of the present application so that a more detailed description of which can be dispensed with.

It is, however, essential that a bevel pinion 10 is provided within the swing pin underframe 1 and is supported centrally in same, which is in operative connection with the pivot drive 16. The teeth on the peripheral area of the said bevel pinion 10 engage into the teeth of a bevel gear 11 which in turn is firmly connected with the lower end of a central control shaft 8 of the collecting pin 3. For this purpose the control shaft 8 is supported in the area of the swing head 2 upon or within a flange tube 23, such flange tube being equally provided both for the collecting pin arrangement pointing upward in FIG. 3 and for the orthogonal collecting pin which is only sketched here. The two flange tubes 23 of the twin pin arrangement are connected with one another through a bevel gear drive 12 as can be seen from FIG. 3, the diameters of the two bevel gears of the bevel gear drive 12 being equal so that a transmission ratio of 1:1 results.

Figure 4:
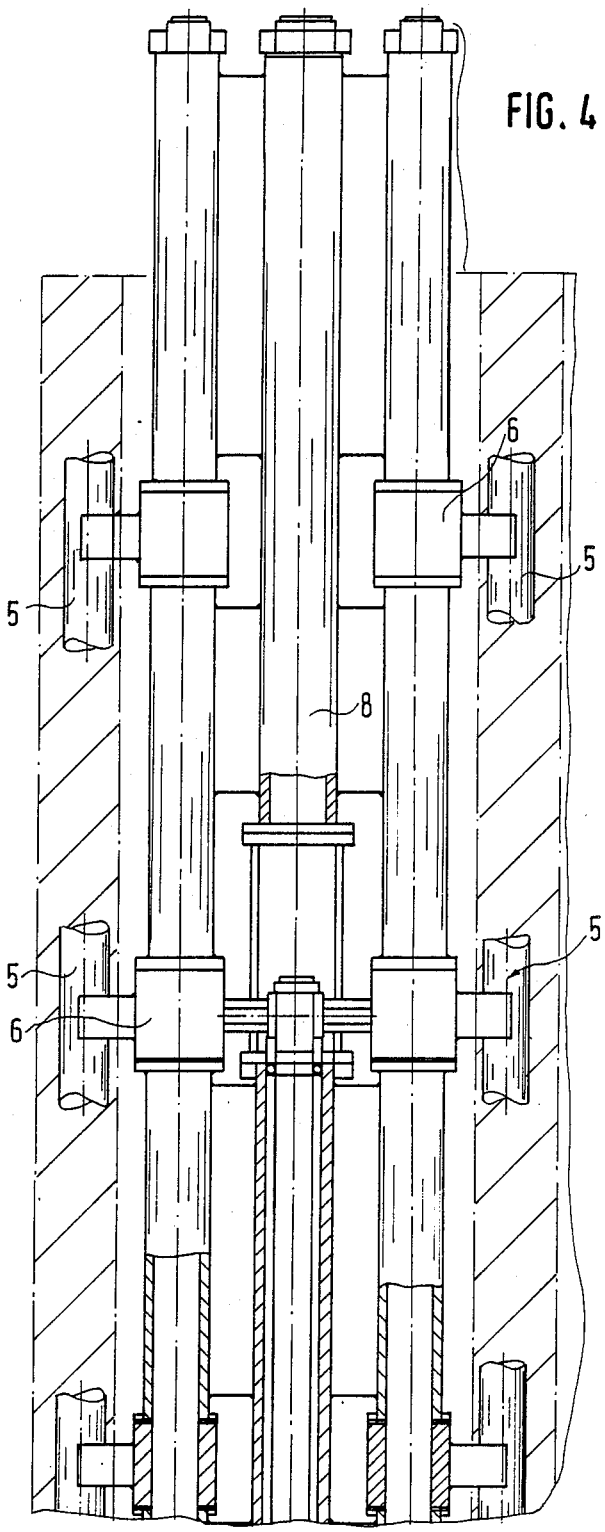
FIG. 4 the upper continuation of the pin build-up of FIG. 3.

. The build-up of the collecting pin 3 which is sectionally shown in FIG. 3 in its lower part only and continues in FIG. 4, is substantially characterized by the central control shaft 8, the fixed pin rods 4 and the movable pin rods 5. The fixed pin rods 4 are, as shown in FIG. 3, supported within a base plate 13 on two-point contact bearings, such base plate being designed with double walls therefor. Rocker arms 6 are held on the fixed pin rods 4 in three planes at the corresponding height and spaced from one another, the movable pin rods 5 being disposed at the free and swingable ends thereof (cf. also FIGS. 5 and 6). In the illustrated embodiment are four movable pin rods 5 disposed between four fixed pin rods 5 each. Said four fixed pin rods 4 are rigidly interconnected by means of bracing ribs 14, whereby such bracing ribs may be provided both between neighboring pin rods 4 and via the central control shaft 8.

Lever arrangements are in turn provided at the control shaft 8 at a certain distance with respect to one another and in differing heights in accordance with the movable rocker arms 6 between such fixed pin rods 4 and such movable pin rods 5. Each one of such lever arrangements consists of a toggle joint lever 9 being rotationally firmly attached to the control shaft 8, a drive lever 7 connected therewith via a joint, and finally, again via a joint member, a swing lever 15 connected with such lever, which is in turn mounted rotatably firmly to the movable pin rod 5. The movable pin rods 5 are shown in FIG. 4 in the area of the rocker arms 6 and in the plane which is characterized by the same and the said lever arrangement only.

Figure 5:
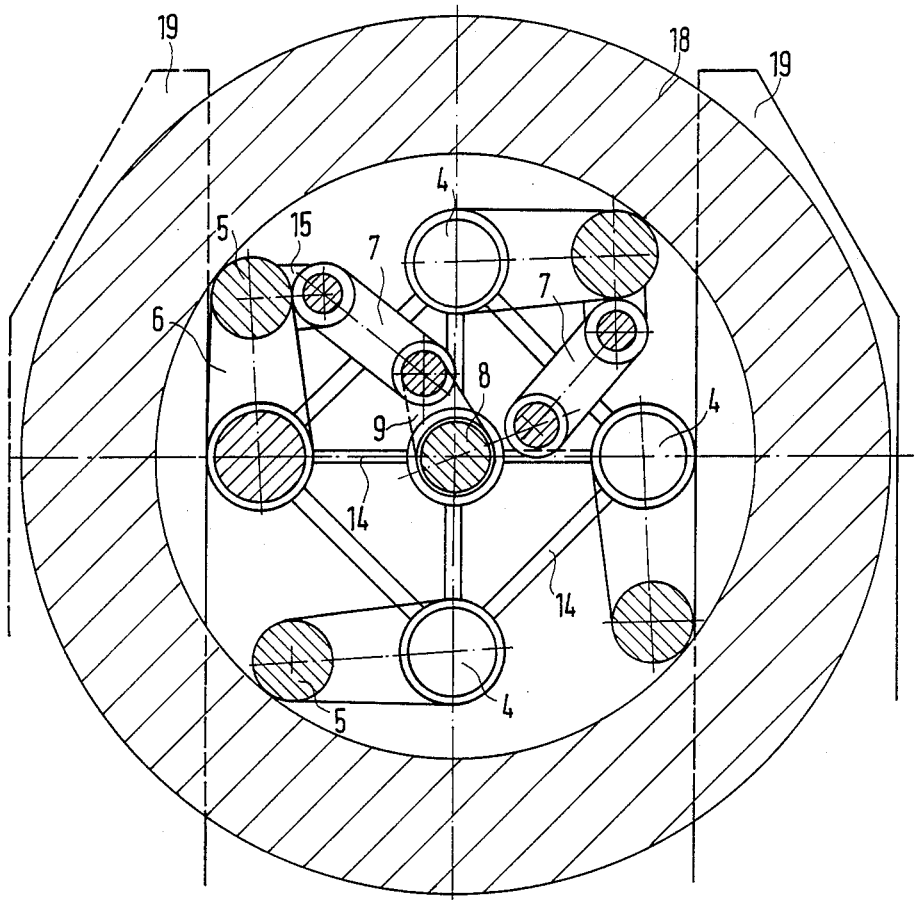
FIG. 5 a cross-section through a pin in its spread-out loading position.
Figure 6:
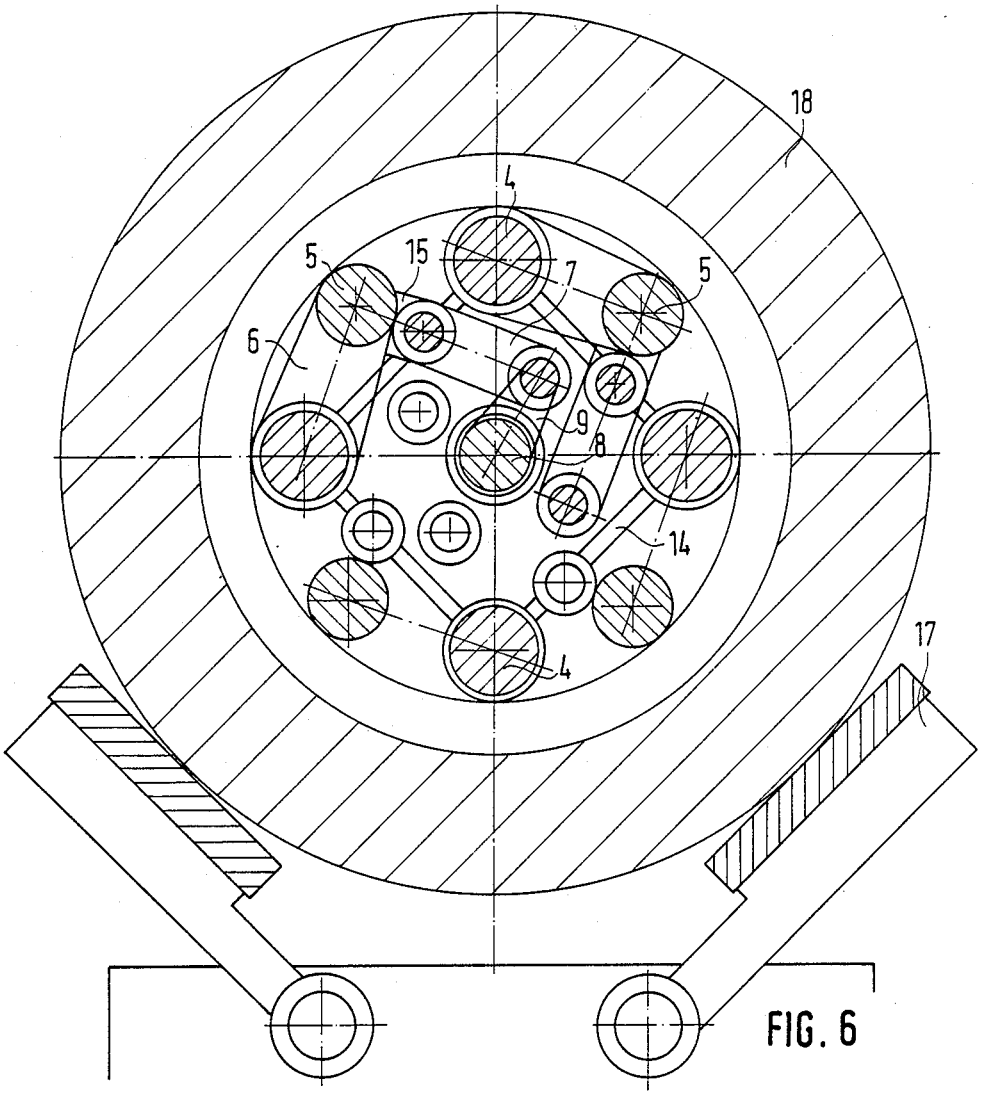
FIG. 6 a cross-section according to FIG. 5, however with contracted pin cross section for taking a wire coil off the pin.

The lever arrangement 9, 7, 15 is therefore swung on rotary movement of the central control shaft 8 via the bevel pinion 10 actuated by the swing drive 16, so that every movable pin rod held in three planes on rocker arms 6 is pushed radially outward as shown in FIG. 5 in cross-section. This position of the movable pin rods 5 characterizes the loading position of the collecting pin 3 with a correspondingly enlarged diameter upon which a wire coil 18 is collected in a manner as such known. After completion of a wire coil then the movable pin rods 5 are brought into a contracted position by means of the lever arrangement 9, 7, 15 in the area of every single rocker are 6 as shown in FIG. 6, which is characterized by a smaller pin diameter. In this discharging position of the collecting pin 3, the wire coil is lying only loosely and at a distance from the collecting pin on discharging levers 17 and can be pulled off without friction between the pin surface and the inner windings of the wire coil.

It is sufficient to only slightly change the enveloping diameter of the collecting pin between the loading and discharging positions for guaranteeing an easy pull-off of the wire coil without damage due to friction.

The forced coupling of the central control shaft with the reciprocating motion of the swing drive arrangement for each of the two collecting pins defines necessarily the contracted and the spread-out pin rod arrangements for the required position each.

The construction of the rocker arms, levers, and joints is such that self-lubricating sinter friction bearings are used so that no supplementary lubrication with additional service is required.

We claim:

1. A wire coil collecting station comprising:

an underframe, a head mounted for pivotal movement on the underframe, at least two collecting pins fixed to the head at an oblique angle to each other, the pivotal movement of the head being such as to transfer the position of the collecting pins with respect to each other, each pin comprising:

a base fixed to the head, pin diameter defining means coupled to the base for defining the diameter of the pin, and a control shaft movable with respect to the base and coupled to the pin diameter defining means for controlling the pin diameter, first gear means fixed to the control shafts of the collecting pins and engaging each other for causing outward displacement of the pin diameter defining means of a first pin simultaneously with an inward displacement of the pin diameter defining means of another pin, and second gear means coupling the underframe to the control shaft of one of the pins for causing displacement of the pin diameter defining means of the at least two pins during movement of the head relative to the underframe.

2. A wire coil collecting station of claim 1 wherein the pin diameter defining means of each pin comprises:

a group of fixed rods fixed to the base in spaced relation to each other, a group of movable rods arranged generally parallel to the fixed rods and movable with respect to the base, and coupling means connected to the control shaft and to the movable rods for causing displacement of the movable rods in response to movement of the control shaft.

3. A wire coil collecting station of claim 2 further comprising a plurality of rocker arms, each rocker arm having a first end and a second, each rocker arm first end being pivotally coupled to one of the plurality of fixed rods, and each rocker arm second end being coupled to one of the movable rods for movement therewith.

4. A wire coil collecting station of claim 3 wherein the plurality of rocker arms of each pin are situated in a plurality of groups of rocker arms, each group of rocker arms being situated at a different distance from the base

5. A wire coil collecting station of claim 2 wherein the coupling means comprises;

a group of lever arms each having a first end and a second end, the first end of each lever arm being fixed to the control shaft for movement therewith, a group of drive levers each having a first end and a second end, the first end of each drive lever being coupled to the second end of one of the lever arms for movement therewith, and a group of swing levers each having a first end and a second end, the first end of each swing lever being coupled to the second end of one of the drive levers for movement therewith, the second end of each swing lever being coupled to one of the movable rods.

6. A wire coil collecting station of claim 2 further comprising a plurality of bracing rods spaced from the base and coupling the fixed rods of each pin to each other.

7. A wire coil collecting station comprising:

an underframe, a head mounted for pivotal movement on the underframe about a pivot axis, and a first and a second collecting pin fixed to the head and orthogonal to each other, the pivotal movement of the head being such as to exchange the position of the collecting pins with respect to each other, each pin comprising:

a base fixed to the head, a group of fixed rods fixed to the base in spaced relation to each other, a group of movable rods arranged generally parallel to the fixed rods, a control shaft centrally situated with respect to the group of fixed rods and movable with respect to the base, and coupling means connected to the control shaft and to the movable rods for causing displacement of the movable rods in response to movement of the control shaft, first gear means fixed to the control shafts of the first and second collecting pins and engaging each other for causing outward displacement of the movable rods of the first pin simultaneously with an inward displacement of the movable rods of the second pin, and second gear means coupling the underframe to the control shaft of one of the pins for causing displacement of the movable rods of both pins during movement of the head relative to the underframe.

8. A wire coil collecting station of claim 7 further comprising a plurality of bracing rods from the base and coupling the fixed rods to each other, and a plurality of rocker arms, each rocker arm having a first end and a second, each rocker arm first end being pivotally coupled to one of the plurality of fixed rods, and each rocker arm second end being coupled to one of the movable rods for movement therewith, the plurality of rocker arms of each pin being situated in a plurality of groups of rocker arms, each group of rocker arms being situated at a different distance from the base and interspersed with the the plurality of bracing rods.

9. A wire coil collecting station of claim 7 wherein the second gear means comprises a first gear fixed to the control shaft of one of the pins and a second gear fixed to the underframe on said pivot axis.

10. A wire coil collecting station comprising:

an underframe, a head mounted for pivotal movement on the underframe, and a first and a second collecting pin fixed to the head and orthogonal to each other, the pivotal movement of the head being such as to exchange the position of the collecting pins with respect to each other, each pin comprising:

a base fixed to the head, a group of fixed rods fixed to the base in spaced relation to each other, a group of movable rods arranged generally parallel to the fixed rods, a control shaft centrally situated with respect to the group of fixed rods and movable with respect to the base, coupling means connected to the control shaft and to the movable rods for causing displacement of the movable rods in response to movement of the control shaft, and a first gear fixed to the control shaft of the first pin and engaging a like gear fixed to the control shaft of the second pin such that movement of the first pin control shaft causing outward displacement of the movable rods of the first pin occurs simultaneously with a contrary movement of the second pin control shaft causing inward displacement of the movable rods of the second pin.

11. A wire core collecting station of claim 10 wherein the coupling means comprises;

a group of lever arms each having a first end and a second end, the first end of each lever arm being fixed to the control shaft for movement therewith, a group of drive levers each having a first end and a second end, the first end of each drive lever being coupled to the second end of one of the lever arms for movement therewith, and a group of swing levers each having a first end and a second end, the first end of each swing lever being coupled to the second end of one of the drive levers for movement therewith, the second end of each swing lever being coupled to one of the movable rods.

12. A wire coil collecting station of claim 10 further comprising a plurality of rocker arms, each rocker arm having a first end and a second end, each rocker arm first end being pivotally coupled to one of the plurality of fixed rods, and each rocker arm second end being coupled to one of the movable rods for movement therewith.

13. A wire coil collecting station of claim 10 further comprising pivot drive means for driving the head relative to the underframe about a pivot axis to exchange the position of the collecting pins with respect to each other, and gear means coupling the underframe to the control shaft of one of the pins for causing displacement of the movable rods of both pins during movement of the head relative to the underframe by the drive means.

14. A wire coil collecting station of claim 13 wherein the gear means comprises a bevel gear fixed to the control shaft of one of the pins and a bevel pinion fixed to the underframe on said pivot axis.

* * * * *